US006562270B1

(12) United States Patent
Gannon et al.

(10) Patent No.: US 6,562,270 B1
(45) Date of Patent: May 13, 2003

(54) COMBINATION CUP INSULATOR/ STABILIZER AND METHOD FOR MAKING THE SAME

(75) Inventors: Richard A. Gannon, Baraboo, WI (US); Neil Bellinger, Honolulu, HI (US)

(73) Assignee: CB International, Inc., Honolulu, HI (US)

( * ) Notice: Subject to any disclaimer, the term of this patent is extended or adjusted under 35 U.S.C. 154(b) by 0 days.

(21) Appl. No.: 09/683,174

(22) Filed: Nov. 28, 2001

(51) Int. Cl.[7] ..... B27N 3/08; A47G 23/02
(52) U.S. Cl. ..... 264/239; 220/739; 220/628
(58) Field of Search ..... 220/739, 630, 220/628, 738, 737; 229/403; 248/311.2; 264/239, DIG. 67, 563

(56) References Cited

U.S. PATENT DOCUMENTS

| | | | | |
|---|---|---|---|---|
| 2,493,633 A | | 1/1950 | Mart | |
| 2,784,577 A | | 3/1957 | Beaham | |
| 3,246,786 A | * | 4/1966 | Holley | 215/393 |
| 3,337,109 A | | 8/1967 | Shumrak | |
| 3,371,819 A | | 3/1968 | Zeman | |
| 3,393,892 A | | 7/1968 | Buck | |
| 4,290,573 A | | 9/1981 | Shapiro | |
| 4,548,348 A | | 10/1985 | Clements | |
| 4,548,349 A | * | 10/1985 | Tunberg | 220/737 |
| 4,726,553 A | | 2/1988 | Wischusen, III | |
| 4,865,199 A | | 9/1989 | Zimmer | |
| D311,477 S | | 10/1990 | Fallgatter | |
| 5,143,247 A | | 9/1992 | Gavle | |
| 5,205,473 A | | 4/1993 | Coffin, Sr. | |
| 5,385,260 A | | 1/1995 | Gatcomb | |

* cited by examiner

*Primary Examiner*—Joseph M. Moy
(74) *Attorney, Agent, or Firm*—Seth M. Reiss

(57) ABSTRACT

A combination disposable cup insulator/stabilizer and the process and method for making the same comprising the steps of selecting a first disposable cup demonstrating a frustoconical configuration, separating the upper portion of the first cup from its lower portion by slicing the cup about its mid-section, discarding the lower portion, and retaining the upper portion for use as a combination insulator/stabilizer. When used a cup liner/insulator, the upper portion of the first disposable cup is slid from below over the outside of a second disposable cup identical in size and shape to the first disposable cup. When used as a cup stabilizer, the upper portion of the first cup is inverted to receive the base of a second disposable cup identical in size and shape to the first disposable cup. The same combination insulator/stabilizer can be fabricated by modifying existing manufacturing facilities to produce top cup portions only. Because the combination insulator/stabilizer is made from the cup it is intended to insulate and stabilize, limited or no additional fabrication facilities are needed and the cup accessory need not be sized or configured for different sized and shaped cups. The combination insulator/stabilizer costs no more to make than the disposable cups they are designed to facilitate and they can be stacked, like the disposable cups, for easy and inexpensive packing, shipping and storage. The combination insulator/stabilizers can be decorated for promotional or aesthetic purposes.

12 Claims, 4 Drawing Sheets

COMBINATION CUP INSULATOR/ STABILIZER AND METHOD FOR MAKING THE SAME

CROSS REFERENCE TO RELATED APPLICATIONS

There are no related patent applications.

FEDERAL STATEMENT

The subject invention is not the result of or in any way related to federally sponsored research or development.

BACKGROUND OF INVENTION

1. Field of Invention

The present invention relates to disposable cups and containers and, more specifically, a method for the manufacture of a combination cup insulator/stabilizer.

2. Description of the Prior Art

Disposable cups and containers are used throughout the fast food industry as well as in specialty foods, carry out locations, offices, work sites, recreational products, the transportation industry and in many other circumstances and environs. Disposable cups and containers are mostly made of foam, paper or plastic.

Cup and container designs have not changed much from their inception. Disposal cups generally exhibit a "frustoconical" configuration consisting of a closed circular base, a conical wall that extends upward and tapers outward from the outer perimeter of the base, and an open, circular mouth or rim. Because the frustoconical configured cups are wider at the top than at the bottom, they become top-heavy and unstable when filled.

Cup instability is of considerable concern in a shifting environment such as on trains, planes and cars, where turbulence or bumps are likely to cause conically shaped cups to tip and the contents to spill out. Instability is also of greater concern when serving hot liquids, and particularly, when serving very hot liquids in frustoconically shaped disposable cups in a shifting or bumpy environment.

In order to compensate for this instability and consequent risk, cups have been designed with wide bottoms and narrow tops. While these designs make the filled container bottom heavy, and stable, such products have very limited commercial feasibility, and are not practicable in the context of disposable cups and containers for the simple reason that they cannot be efficiently stacked for packing, shipping and storage.

It is a primary object of the present invention to provide a means for stabilizing disposable cups and containers demonstrating the ubiquitous frustoconical shape such that they can continue to be stacked for easy and inexpensive packing, shipping and storage.

Known innovations used to stabilize the typical disposable cups include cup bases, coasters and cup assemblies that interact with and shore up the bottom portion of the cups. Prior art cup stabilizers are manufactured separately from the cup, often of durable materials intended for reuse. Differently sized and configured cups require differently sized and configured cup stabilizers. Know cup stabilizers also require manufacturing molds, stamps, dies and tools that are different from the molds, stamps, dies and tools used to manufacture the disposable cups they serve to stabilize. Cup stabilizers fabricated of durable materials for reuse are considerably more expensive to manufacture than the disposable cups they stabilize, rendering them uneconomic for most fast food, carry out and transportation industry uses.

It is a further object of the present invention to provide a cup stabilizer that can be inexpensively fabricated from disposable material, that does not need to be separately sized and configured for each different size and configuration of cup, and that does not require manufacturing facilities separate from the facilities used to manufacture the cups themselves or if additional facilities are required, those additional facilities are limited in their nature and scope.

Some of the materials used to make disposable cups and containers, like foam, are good insulators. Those made of plastic and paper do not insulate well, making them unsuitable for holding very hot and very cold liquids. Even foam cups, if thin-walled, may be unsuitable and/or uncomfortable when holding very hot liquids.

Cup liners and container holders which surround the outside wall of disposable cups to better insulate paper and plastic cups, and thin-walled foam cups, are well known and commercially available. Like the cup stabilizers discussed above, prior art cup liners and container holders are manufactured separately from the cup or container they are designed to insulate and hence require separate manufacturing facilities. Some are constructed of durable materials for reuse, and most must be sized and configured to fit the specific size and configuration of the cup or container they are intended to insulate.

It is a further object of the present invention to provide a cup liner/insulator that does not require manufacturing facilities separate from the facilities used to manufacture the cup to be insulated, or any additional facilities that may be required are limited, that can be inexpensively fabricated from disposable material, and that does not need to be separately sized and configured for different sizes and configurations of cups.

SUMMARY OF INVENTION

These and other objects are accomplished in the present invention, a combination cup insulator/stabilizer and method of making the same. According to the innovative method of the invention, a first disposable cup demonstrating typical frustoconical configuration with a closed circular base, a conical wall that extends upward and tapers outwardly from the outer perimeter of the base, and an open, circular mouth, is divided, by cutting horizontally midway between the cup base and cup rim, along a plane parallel to the cup base. The severed bottom cup portion is discarded and the severed top cup portion can be used either or both as a cup liner/insulator and a cup stabilizer.

When used as a cup liner/insulator, the top cup portion is slid from below over the outside wall of a second disposable cup identical in size and shape to the first disposable cup. When used as a cup stabilizer, the top cup portion is inverted and set on a surface. A second disposable cup identical in size and shape to the first disposable cup is received into the inverted top cup portion of the first cup until the bottom of the second cup rests on the same surface.

According to an alternative embodiment of the invention, the manufacturing facilities used to make a disposable cup of frustoconical configuration are modified in order to make the top half only of a cup identical in size and shape to the cup to be insulated and/or stabilized. Thereafter the top cup portion is used either as a cup liner/insulator or as a cup stabilizer, in the same manner as the top cup portion made by slicing through the middle of a fully formed cup. This alternative method requires some additional manufacturing facilities but eliminates the step of having to discard the bottom cup portion with the consequent waste or recycling of materials.

The combination insulator/stabilizers can be decorated by applying a design to the outside cup portions. The ornamentation can serve promotional or aesthetic purposes, or both. The design applied to the outside of the combination insulator/stabilizer can coordinate with the design applied to the cups the insulator/stabilizer will line and/or stabilize, and it can be reversible so as to be pleasing upright, when functioning as a cup liner, or inverted, when functioning as a cup stabilizer.

Because the combination cup insulator/stabilizer is made from a cup identical to the one it serves to insulate and stabilize, there is no need to specifically size and configure the insulator/stabilizer to differently sized and configured cups. Rather, so long as the combination insulator/stabilizer is made from the cup it lines and stabilizes, and the insulator/stabilizer will always be sized correctly.

Also, because the combination cup insulator/cup stabilizer is made from the cup that it serves to insulate and to stabilize, there is no need for separate or different manufacturing molds, stamps, dies, tools or facilities. The fabrication facilities used to produce the disposable cups and containers are the same facilities used to make the combination insulator/stabilizer. The combination insulator/stabilizer requires only the additional steps of dividing the bottom cup portion from the top cup portion by slicing, and discarding the bottom cup portion. In the case of the alternative method described above, the machinery and manufacturing facilities used to make given disposable cups are modified to make the top cup portion only. These steps require very little in the way of additional or modified machinery or tools, and results in little additional manufacturing time and expense.

Finally, because the combination insulator/stabilizer is made from the same, inexpensive material as the disposable cups they are used in conjunction with, the combination insulator/stabilizer is inexpensive to produce rendering them economic and commercially suitable for all the many uses disposable cups and containers are presently put to.

Due to the fact that the top cup portions of the first disposal cups retain their frustoconical configuration, the combination insulator/stabilizers of the present invention can be stacked, or nested, one within the other, for easy and economical packing, shipping and storage. Also because the combination insulator/stabilizers retain the conical shape of the containers from which they are made, the nested combination insulators/stabilizers can be inserted into cup dispensers for easy dispensation.

Further objects and advantages of this invention will become apparent from consideration of the drawings and ensuing description.

DETAILED DESCRIPTION

Figure 1:
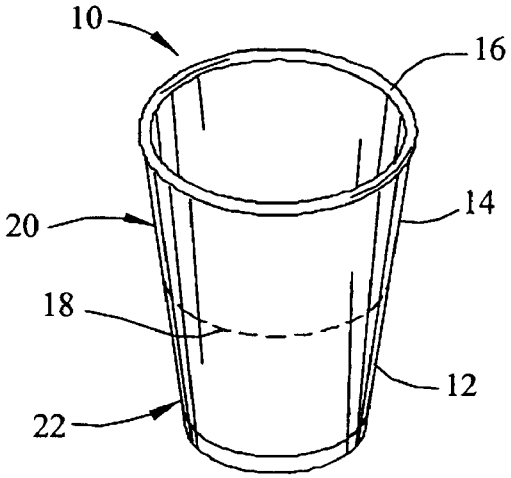
FIG. 1 is a perspective view of a first disposable cup of the subject invention prior to being divided into a bottom cup portion and a top cup portion.

FIG. 1 shows a first disposable cup 10 demonstrating a typical frustoconical configuration prior to being divided into top and bottom portions. Cup 10 comprises a closed circular base 12, a wall 14 extending upwardly and tapering outwardly from the outer perimeter of base 12, and open circular top rim 16 forming the top perimeter of wall 14. Midway along wall 14 between base 12 and rim 16 is a dotted line 18. Slicing through line 18 along a plane parallel to base 12 divides first cup 10 into a top cup portion 20 and a bottom cup portion 22.

Figure 2:
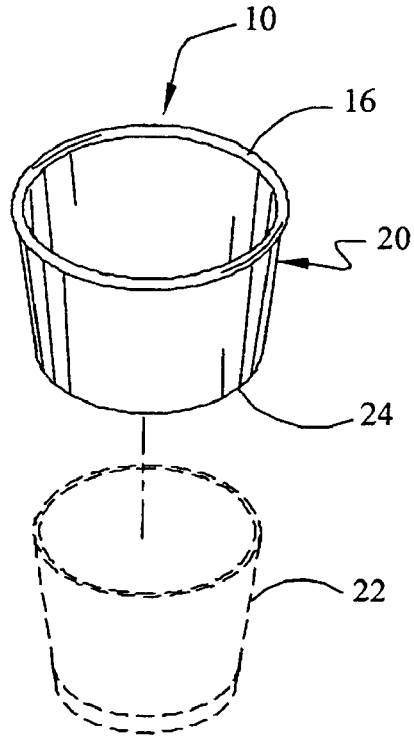
FIG. 2 is an exploded view of the first disposable cup of FIG. 1 after having been severed mid-way between the cup base and cup rim along a plane parallel to the cup base.

FIG. 2 illustrates in exploded view first cup 10 severed along line 18 (shown in FIG. 1) into top cup portion 20 and bottom cup portion 22. Bottom cup portion 22 is discarded, while top cup portion 20 comprising the upper portion of wall 14, top rim 16 and a newly created open circular bottom rim 24 is retained for use as a combination insulator/stabilizer (20).

Figure 3:
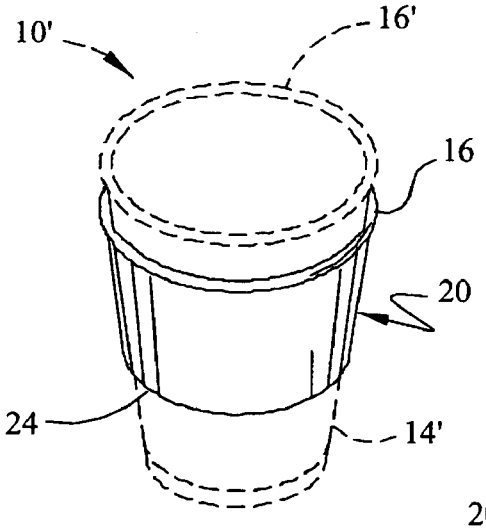
FIG. 3 shows the top cup portion of the first disposable cup of FIG. 1 being used as a liner to insulate the top portion of a second disposable cup having the same configuration as the first disposable cup.

FIG. 3 depicts combination cup insulator/stabilizer 20 used as a cup liner/insulator. Top portion 20 is slid from underneath up and over the outside wall 14' of a second disposable cup 10'. Second disposable cup 10' is identical in size and shape to first disposable cup 10 (shown in FIG. 7) from which top cup portion 20 was taken. Top cup portion 20 is slid up and over outside wall 14' until the inside wall of cup portion 20 rests firmly against the outside upper aspect of wall 14'. Once in place, top portion 20 can be grasped by the user to lift, carry and manipulate cup 10'. Top portion 20 insulates the user's hand from the hot and cold liquids held inside cup 10' and acts as a barrier against liquids escaping from rim 16' of cup 10'.

Figure 4:
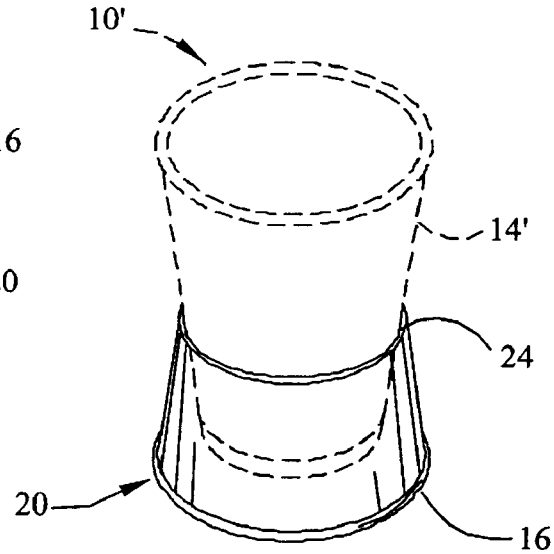
FIG. 4 shows the top cup portion of the first disposable cup of FIG. 1 inverted to receive and stabilize the second disposable cup.

FIG. 4 demonstrates combination cup insulator/stabilizer 20 used as a cup stabilizer. According to this use, top portion 20 is inverted and top rim 16 placed on a resting surface. The bottom of second disposable cup 10' is received into the exposed opening formed by bottom rim 24 of top portion 20 until the base (not shown) of second cup 10' rests on the same surface. When disposable cup 10' is resting within and on the same surface as inverted top portion 20, bottom rim 24 of top portion 20 serves to shore up wall 14' of second cup 10', stabilizing cup 10' and preventing cup 10' from tipping and spilling its contents.

Figure 5:
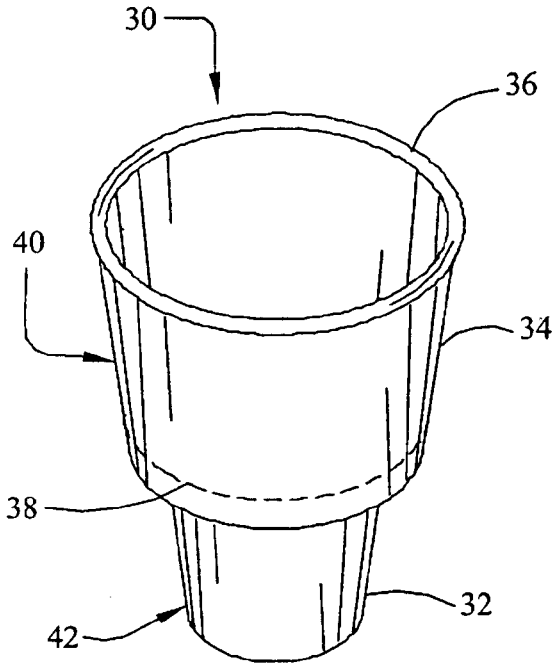
FIG. 5 is a perspective view of an alternative embodiment of a first disposable cup prior to being divided into a bottom cup portion and a top cup portion.
Figure 6:
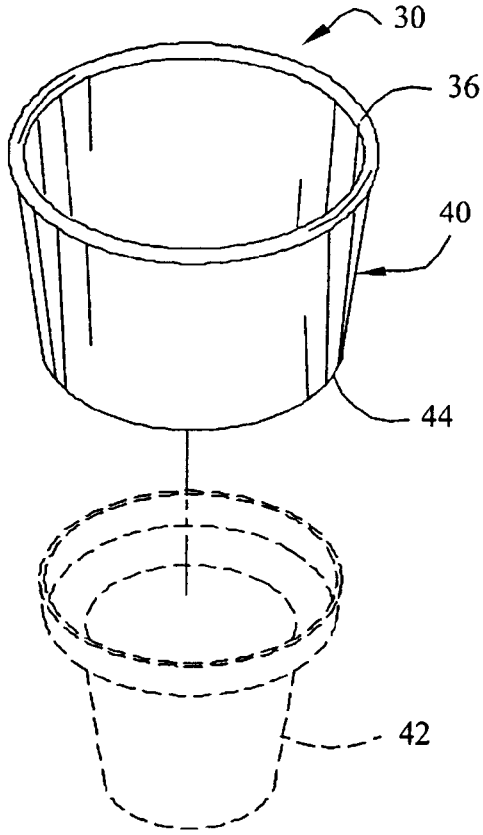
FIG. 6 is an exploded view of the alternative cup of FIG. 5 after having been severed mid-way between the cup base and cup rim along a plane parallel to the cup base.

FIGS. 5 through 8 depict the combination insulator/stabilizer 20 in the context of disposable cups having an alternative frustoconical shape. Referring first to FIG. 5, a first disposable cup 30 having a substantially frustoconical shape comprises a closed circular base 32, a discontinuous but generally conical wall 34 that tapers generally upward and outward from the outer perimeter of base 32, and an open circular rim 36 formed by the upper perimeter of base 32. The upper half of wall 34 is conical in shape and continuous. Midway along wall 34 between base 32 and rim 36 is a line 38. Slicing through line 38 along a plane parallel to base 32 divides first cup 30 into a top cup portion 40 and a bottom cup portion 42, as illustrated in exploded format in FIG. 6. Bottom cup portion 42 is discarded while top cup portion 40 with a top rim 36 and a bottom rim 44 is retained for use as the combination insulator/stabilizer (40).

Figure 7:
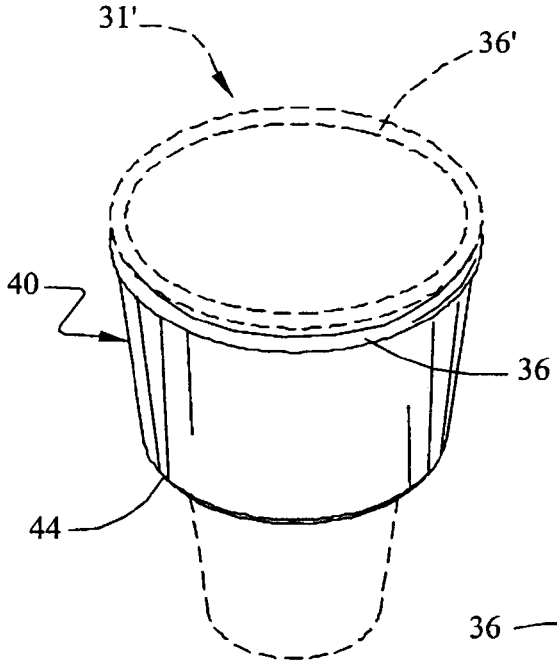
FIG. 7 shows the top cup portion of the alternative cup of FIG. 5 being used as a liner to insulate the top portion of a second disposable cup demonstrating the same alternative embodiment.
Figure 8:
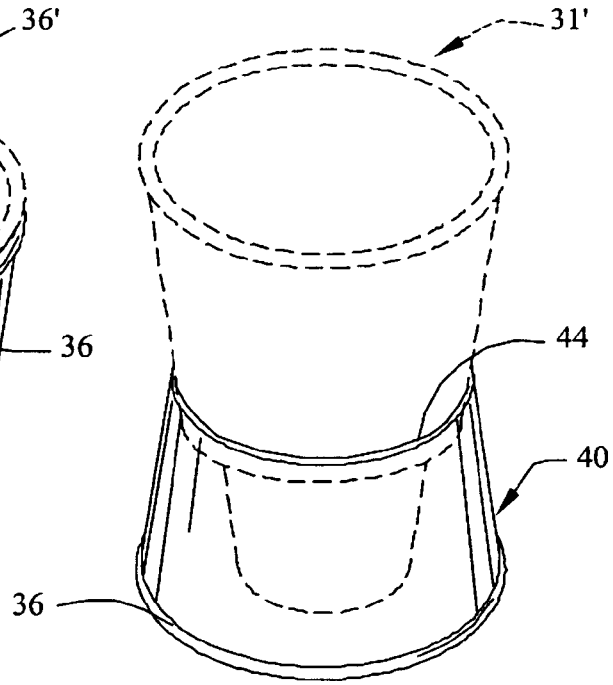
FIG. 8 shows the top cup portion of the alternative cup of FIG. 5 inverted to receive and stabilize the second disposable cup of the same alternative embodiment.

FIG. 7 demonstrates combination insulator/stabilizer 40 functioning as a cup liner/insulator after having been slid up and over the outside wall 34' of a second disposable cup 30' of identical size and shape as first cup 30. FIG.8 demonstrates combination insulator/stabilizer 40 functioning as a cup stabilizer having been inverted with top rim 36 resting on a surface, and second cup 30' having been received through bottom rim 44 of top portion 40 to rest on the same surface as top portion 40.

First disposable cups 20 shown in FIG. 1 can be manufactured with a perforation that corresponds to the dotted line 18 in FIG. 1 and then shipped in stacked configuration. Wholesalers, retailers or users can later separate bottom cup portion 22 from top cup portion 20 along perforation 18 prior to reshipment or use of top portion 20 at the point of sale.

Whereas FIGS. 1 and 2 and FIGS. 5 and 6 illustrate combination insulator/stabilizer 20 and 40 being made by slicing a first disposable cup in half about its mid-section and disposing of the bottom cup portion, top cup portions used to make the combination insulator/stabilizer of the present invention can alternatively be manufactured by modification of existing manufacturing facilities such that only the top halves of cups are produced. In the context of injection molding of foam cups, for example, the molds would be modified so as to produce a top half portion of a cup that is identical in size and shape to the cup the original mold had previously produced. Because the additional manufacturing facilities would involve only modification of existing manufacturing facilities, this alternative method involves only limited expense and additional investment and avoids the expense involved in discarding or recycling bottom cup portions 22 and 42.

Figure 9:
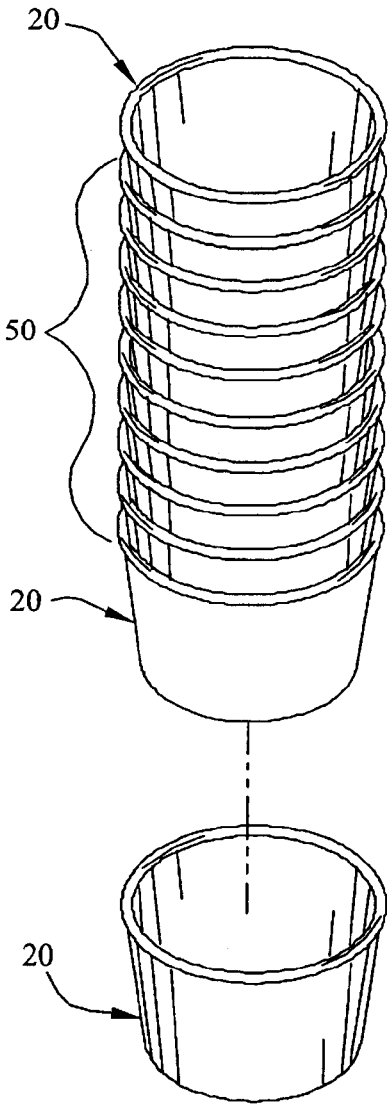
FIG. 9 shows multiple combination cup insulators/stabilizers stacked, one in the other, for easy packing, shipping and storage.

FIG. 9 illustrates the manner in which the combination cup insulator/stabilizer can be stacked for transportation, use and storage. A plurality of combination cup insulators/stabilizers 20 are nested, one inside the other, to form a stack 5O of combination insulators/stabilizers. A plurality of stacks 50 can be economically and efficiently packed, shipped and stored, or made accessible for use by a group. Because stacks 50 are of the same dimensions, and will take up the same space, as a stack of the cups from which combination insulators/stabilizers 20 are made, stacks 50 can be packaged, shipped, stored and set out side by side with stacks of disposable cups which the combination insulators/stabilizers 20 will insulate and/or stabilize.

Figure 10:
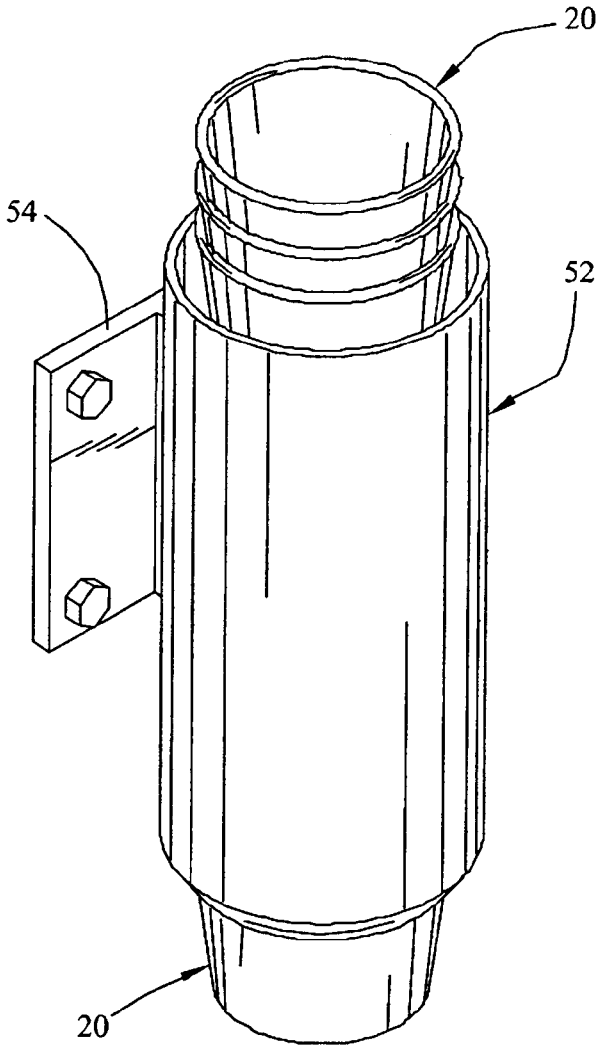
FIG. 10 shows the nested combination insulators/stabilizers of FIG. 9 inserted into a wall cup dispenser.

FIG. 10 depicts a stack of combination cup insulators/stabilizers 20, nested one inside the other, inserted into a cup dispenser 52 having a wall bracket 54. Because combination insulators/stabilizers 20 have the same outside dimensions and configuration as the top portions of the disposable cups they are used in conjunction with, combination insulators/stabilizers 20 will fit and dispense correctly from within the cup dispenser 52 designed for those disposable cups. Stacks 50 of combination insulators/stabilizers 20 are inserted into dispenser 52 from above, and individual insulators/stabilizers 20 are retrieved for use from dispenser 52, one at a time, from below. A fast food restaurant or carry out facility could have two or more cup dispensers 52, one which to store and dispense disposable cups and another to hold and dispense the combination cup insulators/stabilizers 20 intended to accessorize the disposable cups.

Figure 11:
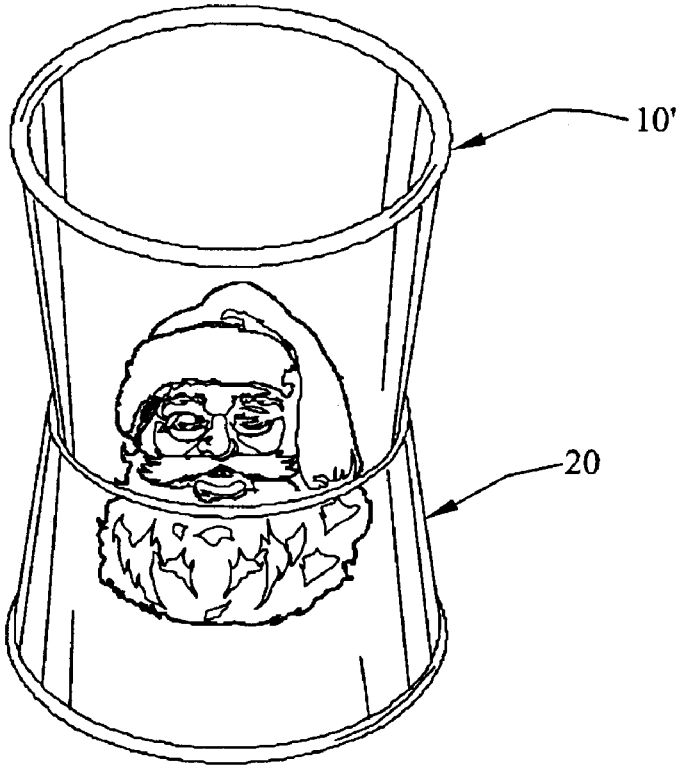
FIG. 11 shows the combination insulator/stabilizer of the present invention decorated to coordinate with decorations applied to a second disposable cup, in use as a stabilizer.
Figure 12:
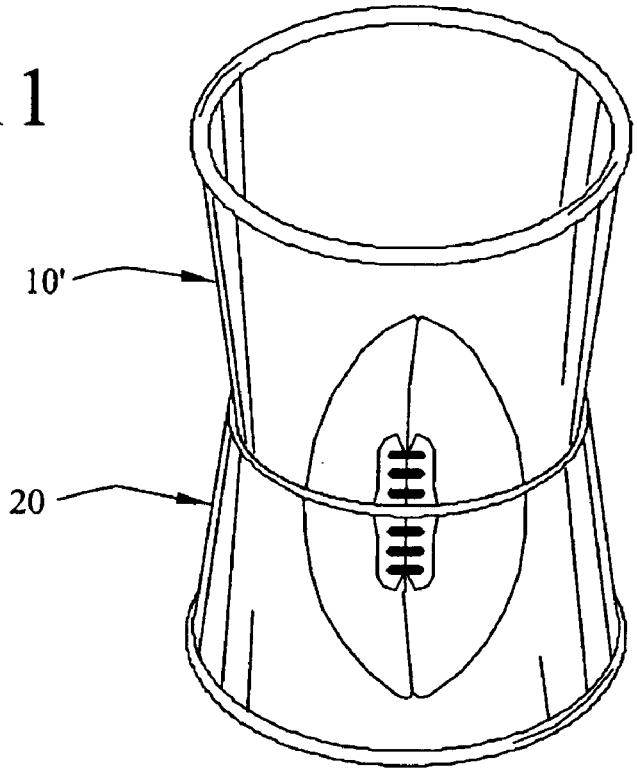
FIG. 12 shows the combination insulator/stabilizer exhibiting a reversible design suitable for use right-side up or upside down, in use as a stabilizer.

FIGS. 11 and 12 illustrate the manner of decorating combination insulator/stabilizer 20 for promotional and/or aesthetic purposes. Depicted in FIG. 11 is an example of insulator/stabilizer 20 decorated to coordinate with the decoration applied to second disposable cup 10'. A beard adorns insulator/stabilizer 20 which, inverted and used to stabilize disposable cup 10', coordinates and enhances the Santa Clause face that has been applied to cup 10'. Depicted in FIG. 12 is a promotional design applied to insulator/stabilizer 20 that is reversible so as to be effective whether used upright as a cup liner or inverted as a cup stabilizer.

SUMMARY AND SCOPE

Accordingly, it will be readily appreciated that the combination disposable cup insulator/stabilizer, and the process and method for making the combination insulator/stabilizer, allows for the introduction of disposable cup and container insulation and/or disposable cup and container stabilization in all arenas in which disposable cups and containers are presently found, at very little cost, with modest or no investment in new manufacturing facilities, without having to concern oneself with size and configuration of the cups and containers, and without having to sacrifice ease or space when packing, shipping or storing. The method and process of the subject invention allows for the production of a combination cup insulator/stabilizer that will in every instance fit snugly and stabilize securely the cup or container from which it is made. The combination insulator/stabilizer uses the same inexpensive materials as the disposable cup and or container they are used in conjunction with.

The combination cup insulator/stabilizer of the present invention facilitates the use of otherwise unstable cups on the beach, picnic blankets, and other uneven surfaces. The outside of the product can be decorated with promotional materials that will display when used as a cup liner or cup stabilizer, or if the materials can be read both upside down and right side up, when used in either fashion.

Whereas the combination insulator/stabilizer of the subject invention has been described and depicted with respect to two styles of frustoconical cups, the method of the invention can be employed for differently shaped cups and for containers which demonstrate a substantially frustoconical configuration without departing from concept of spirit of the invention. Similarly, the manner in which the combination insulator/stabilizer is stacked can be varied such that combination insulator/stabilizers of the subject invention can be stacked together with the cups or containers they are intended to be used with.

The particular embodiments of the combination cup insulator/stabilizer and method for making the same described above are to be considered in all respects as illustrations and not restrictive. The scope of the present invention is as set forth in the appended claims, rather than being limited to the examples set forth in the foregoing description.

The embodiments of the invention to which an exclusive property or privilege is claimed are defined as set forth below.

What is claimed is:

1. A method for insulating disposable liquid containers that demonstrate a frustoconical configuration comprising the steps of:

(a) selecting a first disposable container having a closed circular base, a conical wall that extends upward and tapers outwardly from the outer perimeter of said base, and an open circular mouth formed by the upper perimeter of said wall;

(b) separating the upper portion of said first container from the lower portion of said first container by slicing through said first container midway between the base and mouth of said first container along a plane parallel to the base of said first container;

(c) discarding the lower portion of said first container; and (d) sliding from below the upper portion of said first container around the outside of a said second container identical in size and shape to said first container until said upper portion of said first container fits snugly around the upper portion of said second container.

2. A method for stabilizing disposable liquid containers that demonstrate a frustoconical configuration comprising the steps of:

(a) selecting a first disposable container having a closed circular base, a conical wall that extends upward and tapers outwardly from the outer perimeter of said base, and an open circular mouth formed by the upper perimeter of said wall;

(b) separating the upper portion of said first container from the lower portion of said first container by slicing through said first container midway between the base and mouth of said first container along a plane parallel to the base of said first container;

(c) discarding the lower portion of said first container;

(d) inverting the upper portion of said first container;

(e) inserting the lower portion of a second container identical in size and shape to said first container into the inverted top portion of said first container.

3. A process for the manufacture and use of a combination liquid container insulator/stabilizer comprising the steps of:

(a) selecting a first disposable container having a closed circular base, a conical wall that extends upward and tapers outwardly from the outer perimeter of said base, and an open circular mouth formed by the upper perimeter of said wall;

(b) separating the upper portion of said first container from the lower portion of said first container by slicing through said first container midway between the base and mouth of said first container along a plane parallel to the base of said first container;

(c) discarding the lower portion of said first container;

(d) sliding from below the upper portion of said first container around the outside of a said second container identical in size and shape to said first container for use as an container insulator; and alternatively (e) inverting the upper portion of said first container to receive the lower portion of a second container identical in size and shape to said first container for use as a container stabilizer.

4. The process of claim 3, wherein said container is fabricated from material selected from a group consisting of paper, paperboard, wax paper, polystyrene, and plastic.

5. The process of claim 3, wherein the first and second containers are substantially frustoconical in shape.

6. The process of claim 3, wherein the upper half of the first and second containers are substantially frustoconical in shape.

7. The process of claim 3 further comprising the step of nesting said combination container insulator/stabilizer one inside the other for packing, shipment and storage.

8. The process of claim 7 further comprising the step of inserted said nested combination insulators/stabilizers into a cup dispenser for storage and individual dispensation.

9. The process of claim 3 further comprising, prior to separating the upper portion of said first container from the lower portion of said first container, the step of perforating the wall of said first container midway between the base and mouth along a plane parallel to the base of said first container step to facilitate separating the upper portion of said first container from the lower portion of said first container.

10. The process of claim 3 wherein said upper portion of said first container is adorned for promotional or aesthetic purposes.

11. The process of claim 10 wherein said adornment is coordinated with adornment applied to said second container.

12. The process of claim 10 wherein said adornment functions equally right side up and upside down.

* * * * *